US007644717B2

(12) United States Patent
Hsu

(10) Patent No.: US 7,644,717 B2
(45) Date of Patent: Jan. 12, 2010

(54) HAIR CLIP AND HAIRPIN COMBINATION

(76) Inventor: Wei Cheng Hsu, No. 762, Chengbei Road, Tainan 70948 (TW)

( * ) Notice: Subject to any disclaimer, the term of this patent is extended or adjusted under 35 U.S.C. 154(b) by 363 days.

(21) Appl. No.: 11/717,495

(22) Filed: Mar. 13, 2007

(65) Prior Publication Data

US 2008/0223396 A1 Sep. 18, 2008

(51) Int. Cl.
*A45D 8/22* (2006.01)

(52) U.S. Cl. ..... 132/279; 132/273

(58) Field of Classification Search ..... 132/278, 132/279, 273, 275, 276, 280, 281, 277, 282, 132/148, 173, 144, 146, 242, 132, 135, 134, 132/137; 16/357, 360, 361; 24/513, 523, 24/531, 535, 546, 547, 509, 510, 521, 511; D11/215, 230; D28/27, 31, 32, 39, 40, 42
See application file for complete search history.

(56) References Cited

U.S. PATENT DOCUMENTS 5,638,836 A * 6/1997 Yasuda ..... 132/279
5,758,672 A 6/1998 Chou ..... 132/275
6,019,108 A 2/2000 Chen ..... 132/276
6,192,894 B1 2/2001 Yasuda ..... 132/277
6,257,249 B1 * 7/2001 Thomas et al. ..... 132/273
D540,982 S * 4/2007 Vergona ..... D28/40
2007/0028940 A1 * 2/2007 Coral ..... 132/277
2007/0131239 A1 * 6/2007 Harrison et al. ..... 132/277

* cited by examiner

*Primary Examiner*—Robyn Doan
*Assistant Examiner*—Brianne E O'Neill
(74) *Attorney, Agent, or Firm*—Charles E. Baxley

(57) ABSTRACT

A hair clip and hairpin combining device includes a pin member pivotally coupled to a plate with a pivot axle and for allowing the plate to be rotated relative to the pin member between an open working position and a folded clamping position, and a spring member coupled between the ears and the flaps for maintaining the plate and the pin member either at the open working position as a hairpin or at the folded clamping position as a hair clip, and thus for allowing the hair clip and hairpin combining device to be changeable between the hair clip and the hairpin or for being used as either a hair clip or a hairpin.

5 Claims, 8 Drawing Sheets

HAIR CLIP AND HAIRPIN COMBINATION

BACKGROUND OF THE INVENTION

1. Field of the Invention

The present invention relates to a hair clip and hairpin combination, and more particularly to a hair clip and hairpin combination for being changeable between the hair clip and the hairpin or for being used either as a hair clip or a hairpin.

2. Description of the Prior Art

Typical hair clips comprise a pair of hair retainers or clamping plates having one end portion pivotally coupled together with a pivot shaft, and a spring member disposed or engaged between the hair retainers or clamping plates at the one end portion thereof for biasing the hair retainers or clamping plates toward each other and for forcing the hair retainers or clamping plates to clamp and to retain the hair in place.

For example, U.S. Pat. No. 5,758,672 to Chou, U.S. Pat. No. 6,019,108 to Chen, and U.S. Pat. No. 6,192,894 to Yasuda disclose three of the typical hair clips each also comprising a spring member disposed or engaged between the hair retainers or clamping plates at one end portion thereof, and normally engaged onto a pivot shaft with which the hair retainers or clamping plates are pivotally coupled together, such that the spring member may bias and force the hair retainers or clamping plates toward each other in order to clamp and to retain the hair in place.

However, the typical hair clips may only be used as the hair clips but may not be used as the hairpin or the like for styling the hair of the users.

The present invention has arisen to mitigate and/or obviate the afore-described disadvantages of the conventional hair clip and hairpin combinations.

SUMMARY OF THE INVENTION

The primary objective of the present invention is to provide a hair clip and hairpin combination for being changeable between the hair clip and the hairpin or for being used either as a hair clip or a hairpin.

In accordance with one aspect of the invention, there is provided a hair clip and hairpin combination comprising a pin member for engaging into a user's hair, the pin member including two ears extended from a root portion thereof for forming a space between the ears, a rod secured to the ears and straddled between the ears, a plate including two flaps extended from one end portion thereof for forming a compartment between the flaps and for rotatably receiving the ears of the pin member, the flaps being pivotally coupled to the flaps of the plate with a pivot axle for allowing the plate to be rotated relative to the pin member between an open working position and a folded clamping position, a pole secured to the flaps and straddled between the flaps, and a spring member coupled between the rod and the pole, the spring member and the rod and the pole being movable and retained on one side of the pivot axle for maintaining the plate and the pin member at the open working position and for being used as a hairpin, and the spring member and the rod and the pole being movable and retained on an opposite side of the pivot axle for maintaining the plate and the pin member at the folded clamping position and for being used as a hair clip.

The ears of the pin member each include a cavity formed therein, the flaps of the plate each include a projection extended therefrom for engaging into the cavities of the ears and for forming the pivot axle and for pivotally coupling the ears of the pin member to the flaps of the plate.

The pin member includes at least two fingers extended therefrom and coupled together at the root portion of the pin member for forming a channel between the fingers.

The at least two fingers of the pin member include different lengths for facilitating an engagement of the at least two fingers into the hair of the user.

The pin member includes a base wall coupled between the flaps for forming the compartment between the flaps and the base wall.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 7:
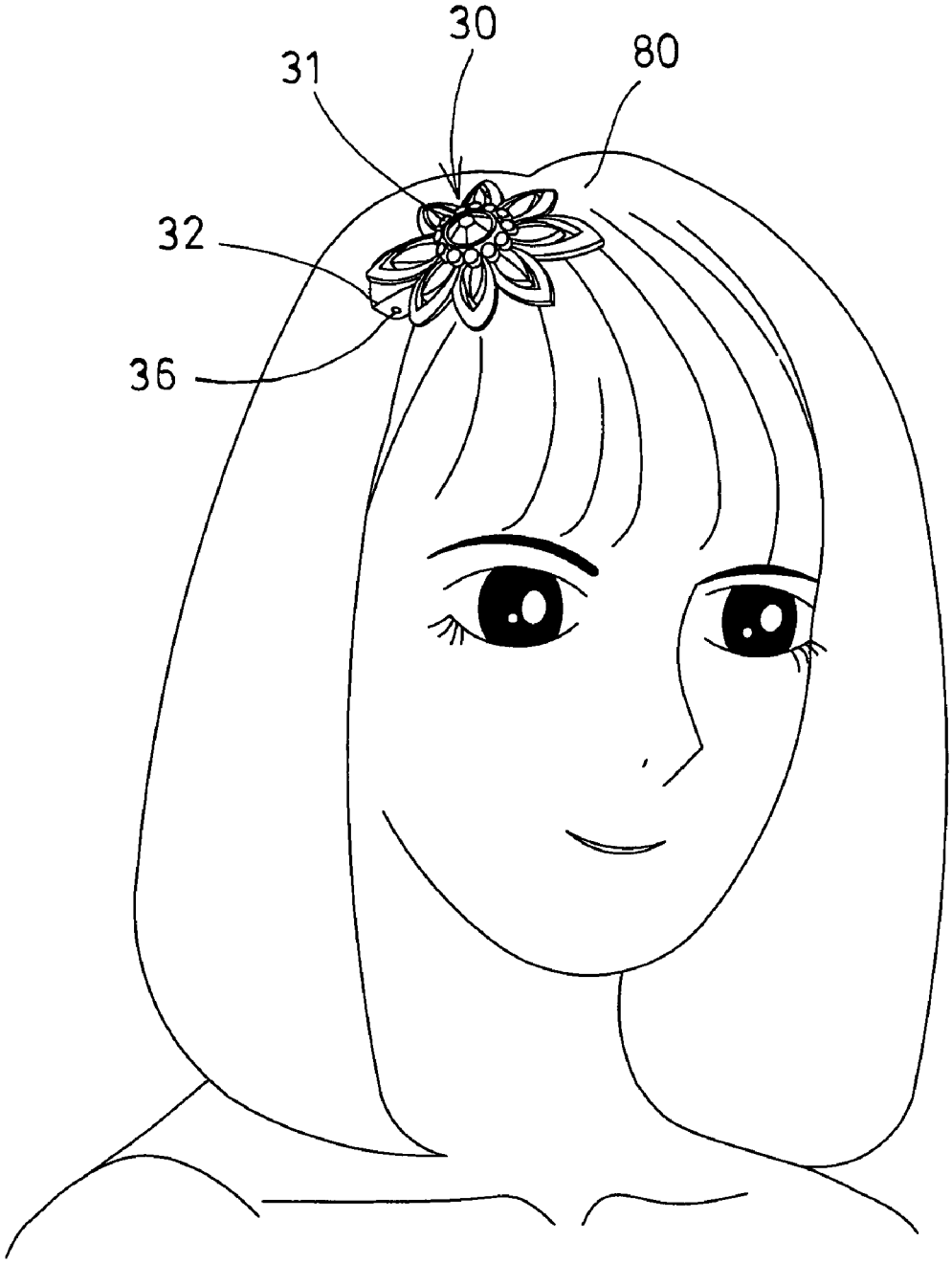
FIGS. 7, 8 are perspective views illustrating the applications of the hair clip and hairpin combination as a hair clip and a hairpin respectively.

Referring to the drawings, and initially to FIGS. 1-4, a hair clip and hairpin combination in accordance with the present invention comprises a pin body or member 10 including one or more (such as two) legs or fingers 11, 12 extended therefrom and coupled together at one end or a root portion 13 for forming or defining a gap or channel 14 between the fingers 11, 12. It is preferable that the fingers 11, 12 of the pin member 10 include different lengths for allowing the fingers 11, 12 to be easily engaged into the hair 80 of the user (FIGS. 7, 8) and for allowing the fingers 11, 12 to be solidly or stably engaged onto and retained and supported on the hair 80 of the user.

Figure 1:
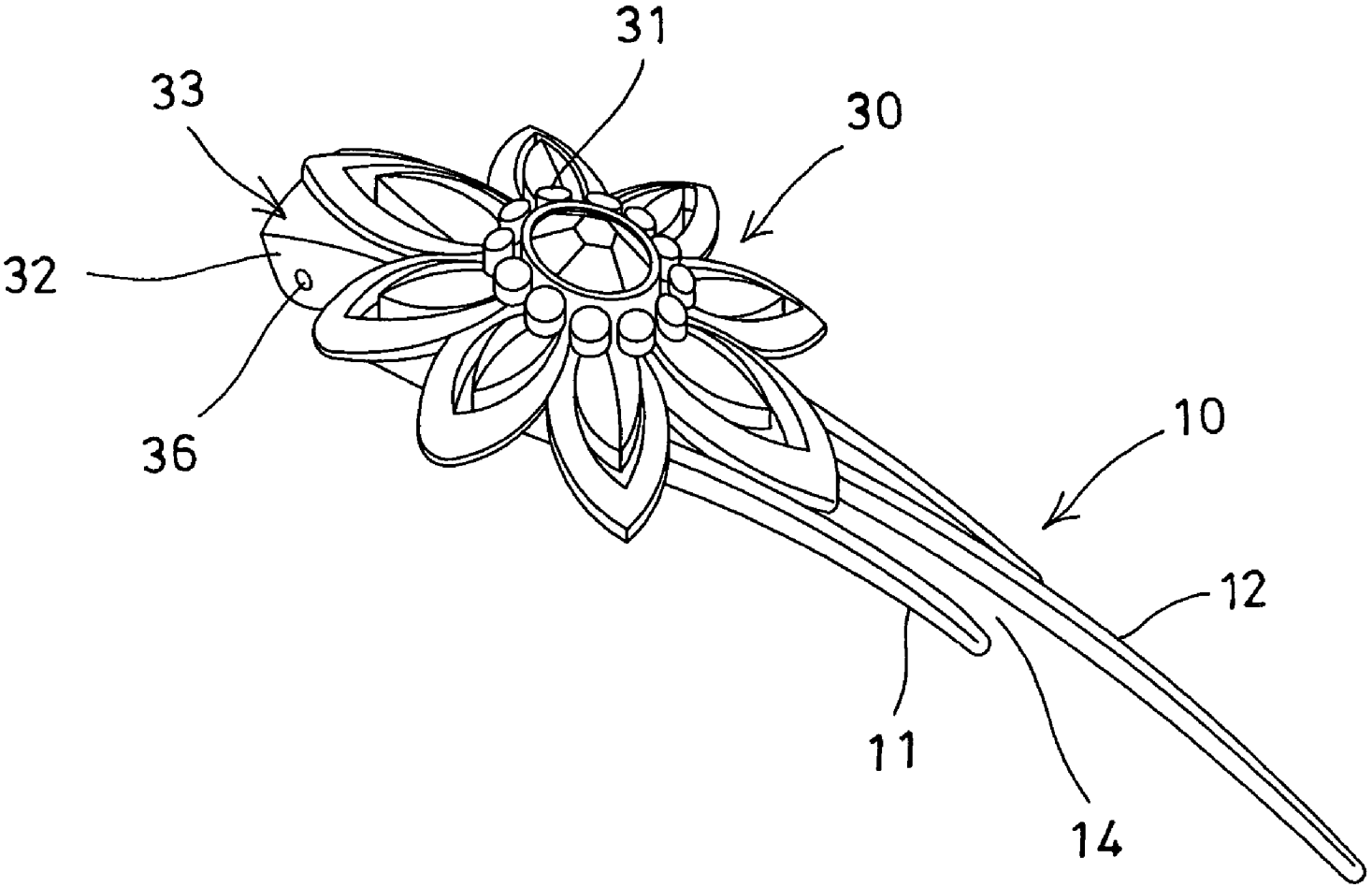
FIG. 1 is a perspective view of a hair clip and hairpin combination in accordance with the present invention, in which the hair clip and hairpin combination is folded at a folding or clamping structure or position for being used as a hair clip.
Figure 2:
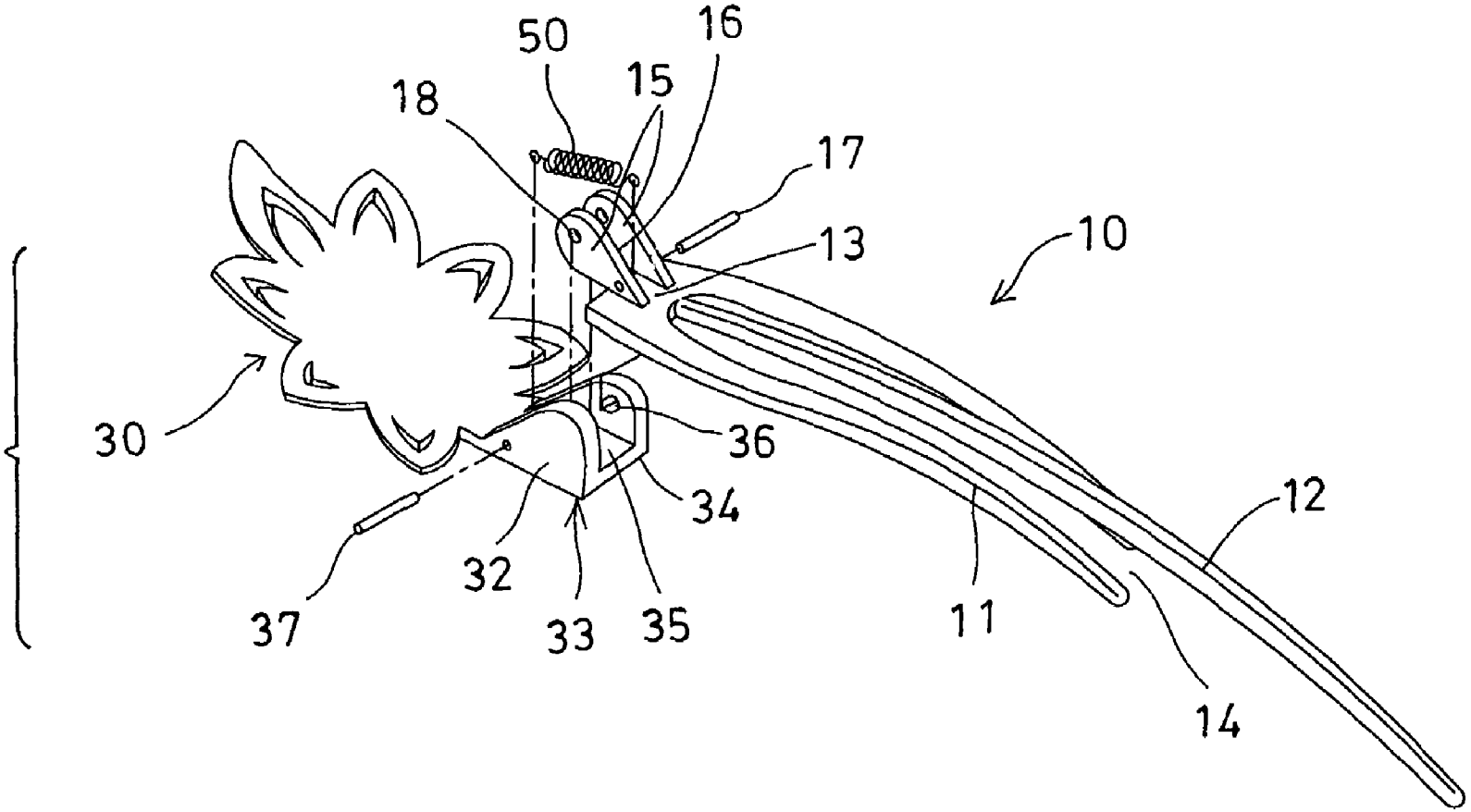
FIG. 2 is an exploded view of the hair clip and hairpin combination.

The pin member 10 includes two ears 15 extended from the one end or root portion 13 thereof for forming or defining a space 16 between the ears 15, and a rod 17 secured to the ears 15 and straddled between the ears 15 and located closer to the one end or root portion 13 of the pin member 10. The ears 15 each include a projection or a cavity 18 formed therein (FIG. 2). A plate 30 includes an ornament pattern or member 31 formed or provided on the outer portion of the plate 30 and includes two flaps 32 extended from one end portion 33 thereof, and a base wall 34 coupled between the flaps 32 for forming or defining a compartment 35 between the flaps 32 and the base wall 34 (FIG. 2) and for rotatably receiving the ears 15 of the pin member 10 (FIGS. 3-6).

The flaps 32 each include a cavity or a projection 36 extended therefrom (FIG. 2) for engaging into the corresponding cavity 18 of the ears 15 and thus for pivotally or rotatably coupling or attaching the flaps 32 of the plate 30 to the ears 15 of the pin member 10, such that the projections 36 of the flaps 32 and the cavities 18 of the ears 15 may thus be formed or acted as a pivot axle 36 for pivotally or rotatably coupling or attaching the flaps 32 of the plate 30 to the ears 15 of the pin member 10. A pole 37 is secured to the flaps 32 and straddled between the flaps 32 and located between the flaps 32 and the base wall 34 or the one end portion 33 of the plate 30 and the ornament pattern or member 31. A spring member 50 is coupled between the rod 17 and the pole 37.

Figure 3:
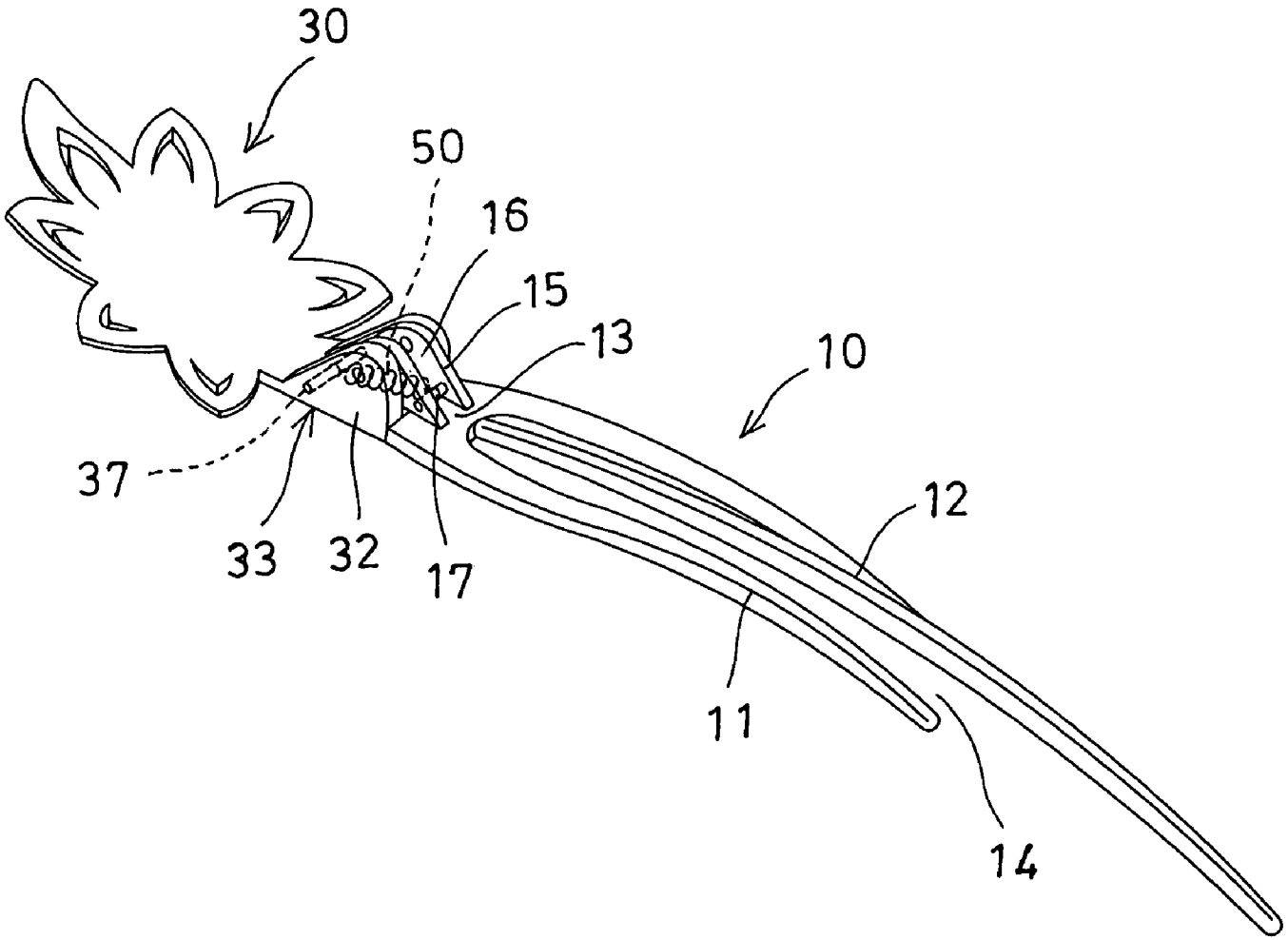
FIG. 3 is a perspective view of the hair clip and hairpin combination in which the hair clip and hairpin combination is opened at an unfolding or working structure or position for being used as a hairpin.
Figure 4:
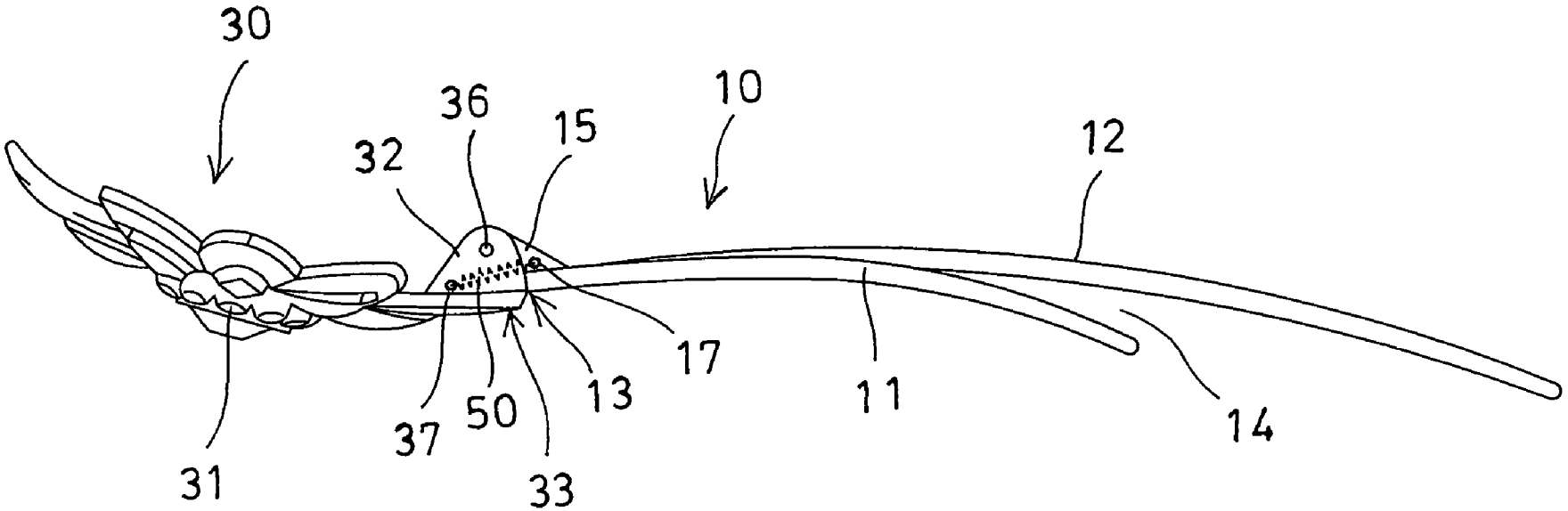
FIG. 4 is a side plan schematic view of the hair clip and hairpin combination as shown in FIG. 3, FIGS. 5, 6 are side plan schematic views similar to FIG. 4, illustrating the operation of the hair clip and hairpin combination.
Figure 5:
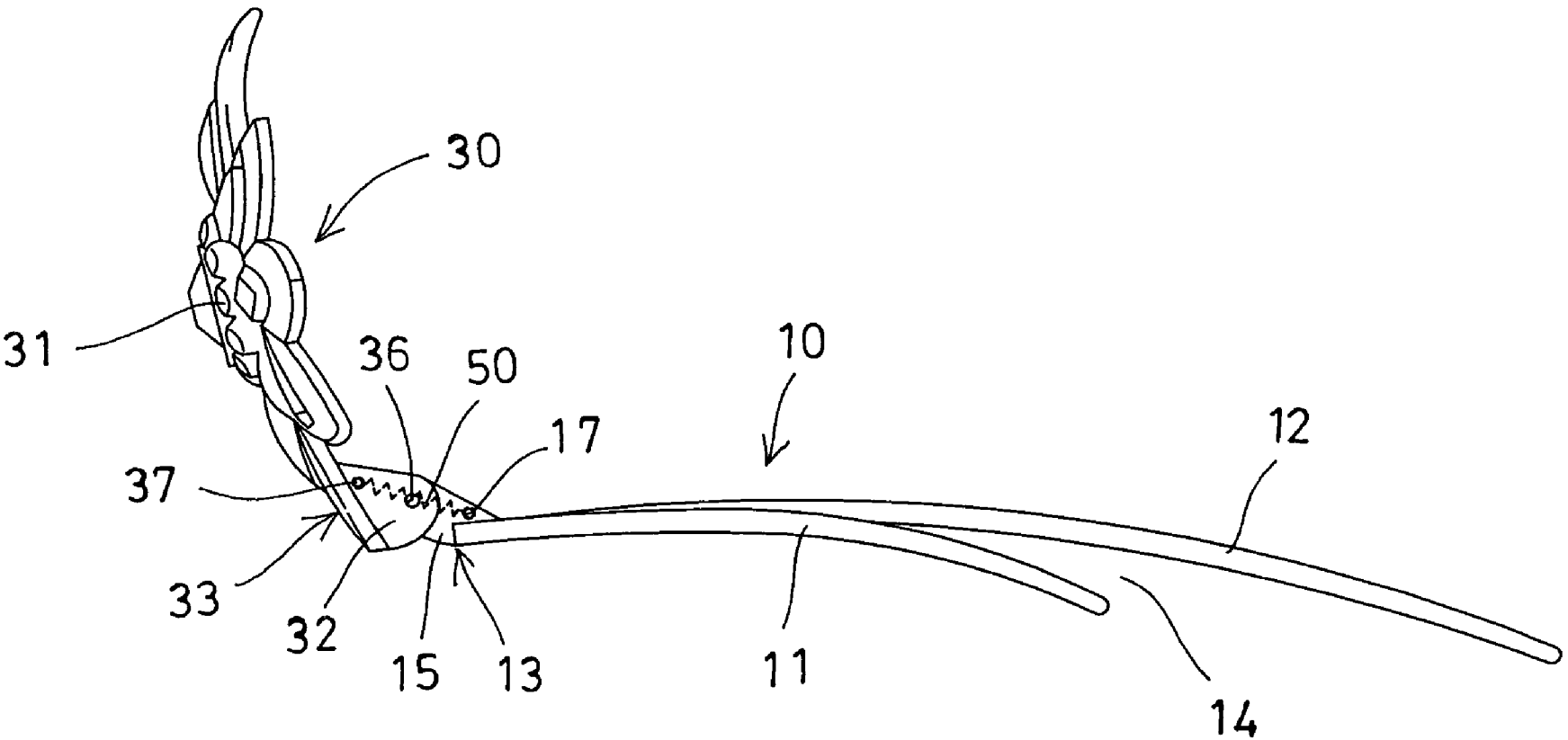
Figure 6:
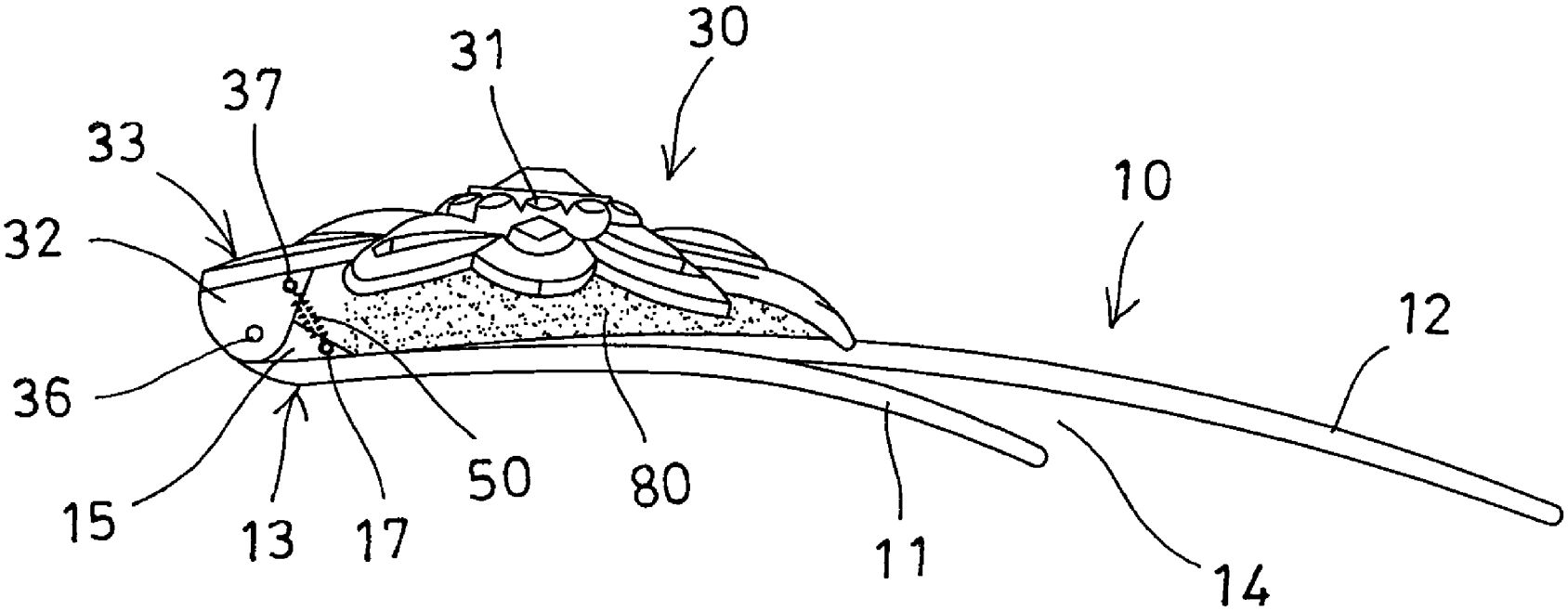
Figure 8:
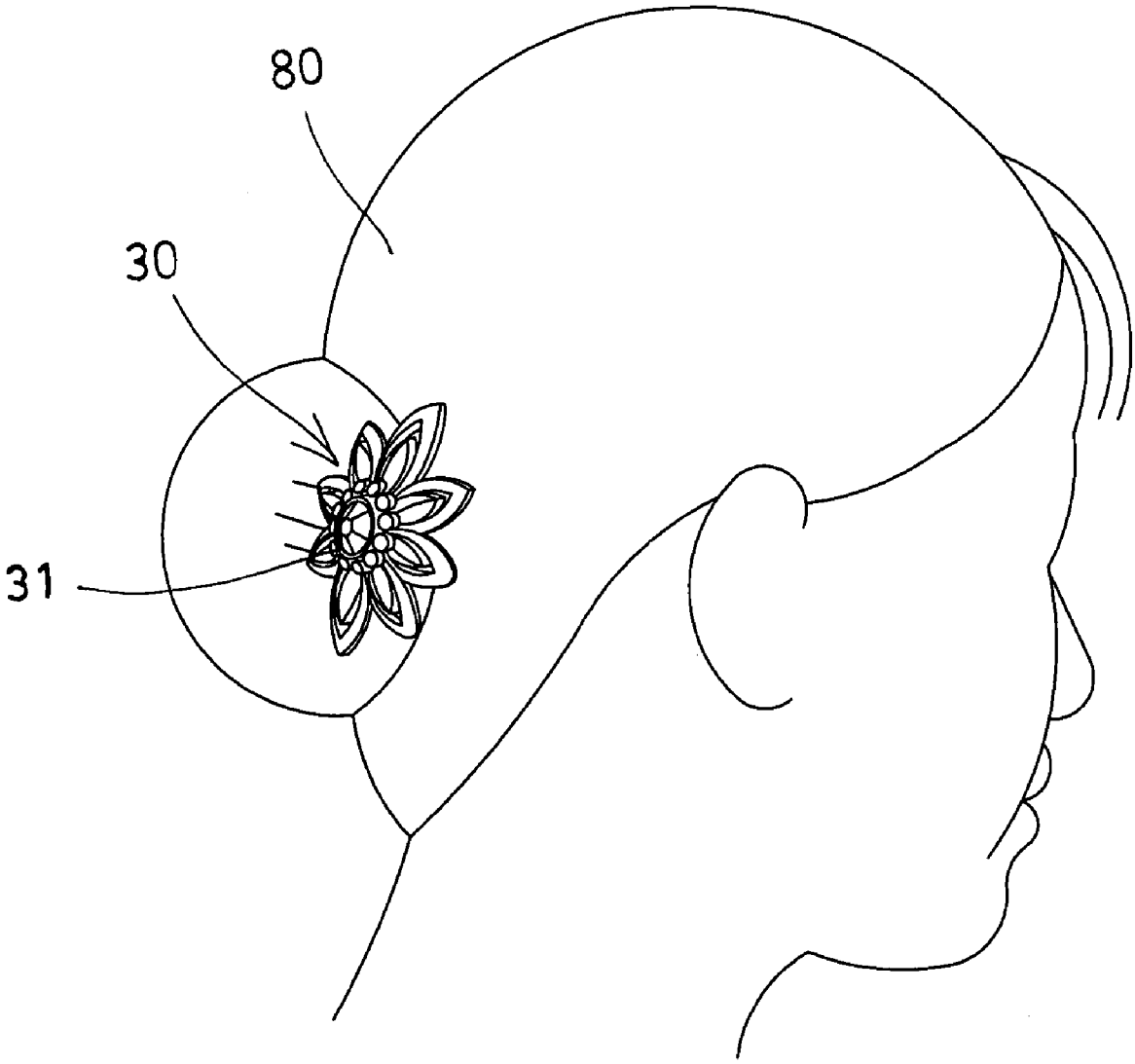

In operation, as shown in FIGS. 3-4 and 8, when the plate 30 and the pin member 10 are unfolded or opened relative to each other to an unfolding or open working structure or position, the rod 17 and the pole 37 and the spring member 50 may be located at one side or the lower portion of the pivot axle 36 such that the spring member 50 may force and retain the plate 30 and the pin member 10 at the unfolding or working structure or position and may maintain the plate 30 and the pin member 10 at a straight or open working structure or position for being used as a hairpin (FIG. 8). When the plate 30 and the pin member 10 are folded or rotated relative to each other until the rod 17 and the pole 37 and the spring member 50 are moved through the pivot axle 36 (FIG. 5) toward the other side or the opposite side or the upper portion of the pivot axle 36, the spring member 50 may force and bias the plate 30 toward the pin member 10 (FIGS. 6, 7) and may maintain the plate 30 and the pin member 10 at a clamped or folded receiving structure or position for being used as a hair clip to solidly or stably clamp the hair 80 of the user between the plate 30 and the pin member 10.

Accordingly, the hair clip and hairpin combination in accordance with the present invention includes a structure for being changeable between the hair clip and the hairpin or for being used as either a hair clip or a hairpin.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair clip and hairpin combination comprising:

a pin member for engaging into a user's hair, said pin member including two ears extended from a root portion thereof for forming a space between said ears, a rod secured to said ears and straddled between said ears, a plate including two flaps extended from one end portion thereof for forming a compartment between said flaps and for rotatably receiving said ears of said pin member, said ears of said pin member being pivotally coupled to said flaps of said plate with a pivot axle for allowing said plate to be rotated relative to said pin member between an open working position and a folded clamping position, a pole secured to said flaps and straddled between said flaps, and a spring member coupled to said rod and said pole and coupled between said rod and said pole, said rod and said pin member being movable away from said pole and said plate and said spring member being movable over said pivot axle and retained on one side of said pivot axle for maintaining said plate and said pin member at the open working position and for being used as a hairpin, and said rod and said pin member being biased toward said pole and said plate and, said spring member being movable over said pivot axle and retained on an opposite side of said pivot axle for maintaining said plate and said pin member at the folded clamping position and for being used as a hair clip.

2. The hair clip and hairpin combination as claimed in claim 1, wherein said ears of said pin member each include a cavity formed therein, said flaps of said plate each include a projection extended therefrom for engaging into said cavities of said ears and for forming said pivot axle and for pivotally coupling said ears of said pin member to said flaps of said plate.

3. The hair clip and hairpin combination as claimed in claim 1, wherein said pin member includes at least two fingers extended therefrom and coupled together at said root portion of said pin member for forming a channel between said fingers.

4. The hair clip and hairpin combination as claimed in claim 3, wherein said at least two fingers of said pin member include different lengths for facilitating an engagement of said at least two fingers into the hair of the user.

5. The hair clip and hairpin combination as claimed in claim 1, wherein said plate includes a base wall coupled between said flaps for forming said compartment between said flaps and said base wall.

* * * * *